US005335379A

United States Patent [19]

Waldo

[11] Patent Number: 5,335,379

[45] Date of Patent: Aug. 9, 1994

[54] TOILET BOWL FLUSHING ATTACHMENT

[76] Inventor: David L. Waldo, 43 Summit St., W. Franklin, N.H. 03235

[21] Appl. No.: 101,022

[22] Filed: Aug. 3, 1993

[51] Int. Cl.[5] ..... A47K 4/00

[52] U.S. Cl. ..... 4/661; 4/420; 4/231

[58] Field of Search ..... 4/231, 300.3, 420, 661, 4/666

[56] References Cited

U.S. PATENT DOCUMENTS

| | | | |
|---|---|---|---|
| 1,067,472 | 7/1913 | Creed | 4/231 |
| 2,407,005 | 9/1946 | Haley | 4/300.3 X |
| 2,808,594 | 10/1957 | Hodgson | 4/666 |
| 2,838,763 | 6/1958 | Brennan | 4/666 |
| 3,466,145 | 9/1969 | Van Duyne | 4/661 X |
| 3,723,998 | 4/1973 | Wehr | 4/300.3 |
| 4,050,101 | 9/1977 | Logue | 4/300.3 |

FOREIGN PATENT DOCUMENTS

| | | | |
|---|---|---|---|
| 0009226 | of 1911 | United Kingdom | 4/420 |

*Primary Examiner*—Charles E. Phillips

*Attorney, Agent, or Firm*—E. Michael Combs

[57] ABSTRACT

An toilet bowl flushing attachment is disclosed. The attachment has a central or main body section. Extending integrally and angularly from one side of the main body section is a first water deflecting fin. A second water deflecting fin extends integrally and angularly from an opposite side of the main body section. A channel-shaped bracket for mounting the attachment on the toilet bowl rim extends integrally and upwardly from a central portion of the main body at a top edge thereof. The bracket is dimensioned to snugly receive the rim within its channel defined by a base and a pair of parallel leg members so that the boy and the pair of fins extend into the bowl. The detachment may be detachably secured to the rim merely by the frictional engagement with the bracket, by suction cups attached to the bracket and pressed against the rim, or it may be permanently secured to the rim by discs glued to the bracket and the rim. The attachment is molded in one piece and composed of polymeric material. The bowl may be may be disinfected by tablets mounted on a deflecting fin.

11 Claims, 4 Drawing Sheets

TOILET BOWL FLUSHING ATTACHMENT

BACKGROUND OF THE INVENTION

1. Field of the Invention

The field of the invention relates to toilet bowl flushing enhancers, and more particularly to an attachment which is mountable on the rim of a toilet bowl and extends into the bowl. The attachment is configured to increase the swirling action of the flushing water which is introduced into the bowl.

2. Description of the Prior Art

A wide variety of toilet flushing systems are present in the prior art. In these known systems, water is released from water tanks, flows down into the bowls, and is discharged from holes under the rims. These holes are designed to impart a swirling movement of the water to remove any deposits from the inside surfaces of the bowls and to drive the water and waste material therein to the center of the bowls and downwardly into the sanitary discharge piping. However, these known toilet arrangements seldomly effect cleaning and discharge by a single flush due to insufficient swirling action and water velocity, and thus usually require inefficient and wasteful second, and sometimes third, flushings.

Exemplary flushing systems utilized in the prior art are as follows:

U.S. Pat. No. 4,710,987 to Means et al sets forth a flexible water distributor which is compressively held in a downwardly open flush rim of a toilet bowl. The distributor is provided with angled slits and radial openings to force flushing water in a partially horizontal direction to permit the water to flow directly against the bowl inner wall.

U.S. Pat. No. 4,930,167 to Ament discloses a toilet having a configuration to generate vortex water flushing action including structure within the rim for receiving a metered amount of water from the tank and directing it through a pair of angled passages of different sizes and into the rim cavity in opposite directions. The water is angularly discharged from the rim and into the bowl.

U.S. Pat. No. 5,005,224 to Carmichael illustrates a toilet bowl attachment for male users for preventing urine splashing and reducing noise. The attachment includes a ceramic dish having a concave shape compatible with the swirling flushing water. The dish is positioned within the bowl adjacent the rim and is removably held therein by a counterbalance positioned outside the bowl and connected to the dish by monofilament line draped over the rim.

U.S. Pat. No. 5,033,129 to Gajewski shows a toilet flushing system positioned in the tank, wherein the system includes a pair of separately operable units arranged at different heights to control the amount of flushing water dispensed as a function of the type of waste to be discharged from the bowl.

U.S. Pat. No. 5,077,840 to Masters et al illustrates another toilet bowl attachment for male users to channel or guide urine into a pan or bowl comprising a polymeric, substantially semi-circular channel member which is open at one or both ends. The attachment is provided with flange and other securing means adjacent an open end to position it in an angled or tilting manner on the rim or top surface of the pan.

As such, it may be appreciated that there continues to be a need for a new and improved toilet bowl flushing attachment which addresses both the problems of ease of use, portability, and effectiveness in construction, and in this respect, the present invention fulfills this need.

SUMMARY OF THE INVENTION

In view of the foregoing disadvantages inherent in the known types of toilet bowl flushing enhancers now present in the prior art, the present invention provides a toilet bowl flushing attachment which is mountable on the bowl rim and has a body member which extends into the bowl for intercepting the water and waste material in the bowl and expediting its discharge therefrom. As such, the general purpose of the present invention, which will be described subsequently in greater detail, is to provide a new and improved toilet bowl flushing attachment which has all the advantages of the prior art toilet bowl flushing enhancers and none of the disadvantages.

To attain this, the present invention includes a toilet bowl flushing attachment comprising a central or main body section. Extending integrally and angularly from one side of the main body section is first water deflecting fin. A second water deflecting fin extends integrally and angularly from an opposite side of the main body section. A channel-shaped bracket for mounting the attachment on the toilet bowl rim extends integrally and upwardly from a central portion of the main body at a top edge thereof. The bracket is dimensioned to snugly receive the rim within its channel defined by a base and a pair of parallel leg members so that the body and the pair of fins extend into the bowl. The attachment may be detachably secured to the rim merely by the frictional engagement with the bracket, by suction cups attached to the bracket and pressed against the rim, or it may be permanently secured to the rim by discs glued to the bracket and the rim. The attachment is molded in one piece and composed of polymeric material. The bowl may be disinfected by tablets mounted on a deflecting fin.

My invention resides not in any one of these features se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the invention to provide a new and improved toilet bowl flushing attachment which has all the advantages of the prior art toilet bowl flushing enhancers and none of the disadvantages.

It is another object of the present invention to provide a new and improved toilet bowl flushing attachment which may be easily and efficiently manufactured and marketed.

It is a further object of the present invention to provide a new and improved toilet bowl flushing attachment which is of durable and reliable construction.

An even further object of the present invention is to provide a new and improved toilet bowl flushing attachment which is susceptible of a low cost of manufacture with regard to both materials and labor, and which accordingly is then susceptible of low prices of sale to the consuming public, thereby making such toilet bowl flushing attachments economically available to the buying public.

Still yet another object of the present invention is to provide a new and improved toilet bowl flushing attachment which provides in the apparatuses and methods of the prior art some of the advantages thereof, while simultaneously overcoming some of the disadvantages normally associated therewith.

Still another object of the present invention is to provide a new and improved toilet bowl flushing attachment which is shaped to generate an increased swirling action of the flushing water in the bowl to thereby induce turbulence in the water which increases its scrubbing action on the wall of the bowl and thus effects a more complete cleaning thereof.

Still another object of the present invention is to provide a new and improved toilet bowl flushing attachment which is configured to increase the velocity of the flushing water which causes a reduction in flushing time and water consumption and thereby eliminates wasteful multiple flushings.

Yet another object of the present invention is to provide a new and improved toilet bowl flushing attachment which is shaped to increase the swirling action, turbulence, and velocity of the flushing water which cause, in combination, the water and waste material to be directed toward the center of the bowl to effect a more complete flushing thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
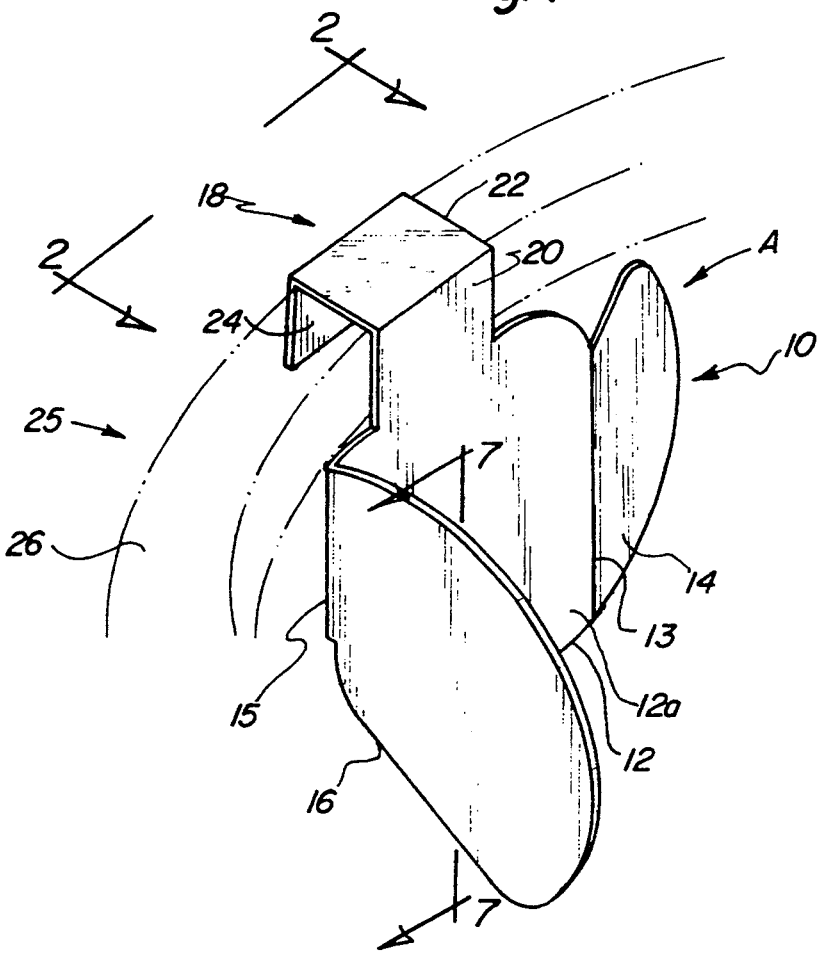
FIG. 1 is a perspective view of the toilet bowl flushing attachment of the present invention.

With reference now to the drawings, and in particular to FIGS. 1–8 thereof, a new and improved toilet bowl flushing attachment embodying the principles and concepts of the present invention and generally designated by the reference numeral 10 will be described.

Figure 2:
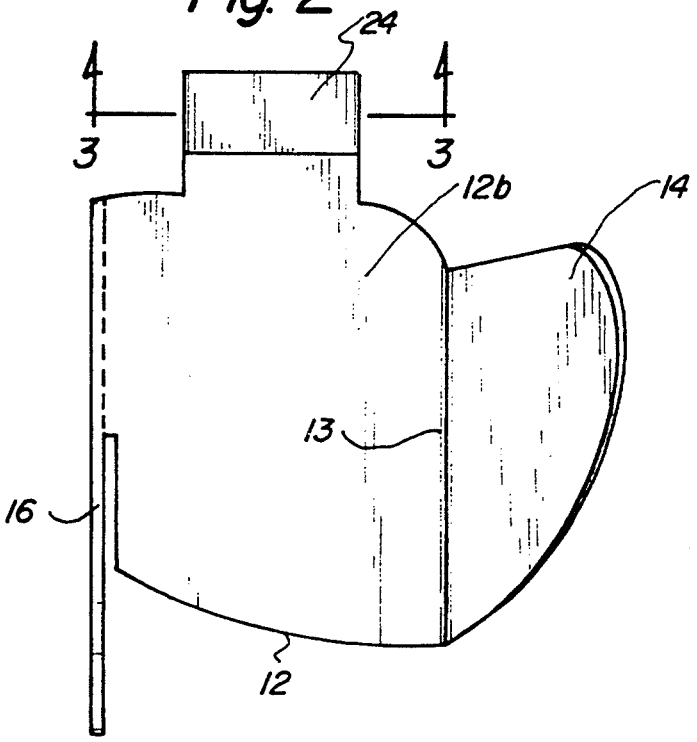
FIG. 2 is a rear elevational view of the toilet bowl flushing attachment as viewed in the direction of the arrows along line 2—2 in FIG. 1.

More specifically, and with particular reference to FIGS. 1 and 2, the toilet bowl flushing attachment 10 of the present invention essentially comprises a centrally positioned, substantially planar main body section 12. Extending integrally and angularly from a fold line defining one side 13 of body section 12 is a first water deflecting fin 14 which is dimensioned to contact the inner wall of toilet bowl 25 when attachment 10 is secured in its operative position therein as shown in FIG. 1. A second water deflecting fin 16 extends integrally and angularly from another fold line defining an opposite side 15 of body section 12. Fin 16 extends outwardly from body section 12 at an angle of approximately 90 degrees, whereas fin 14 extends outwardly from body section 12 in a direction opposite to that of fin 16 and defines an acute angle relative to the front planar face **12*a* of body section 12, as well as an obtuse angle relative to the rear planar face 12*b* thereof. A channel-shaped mounting bracket 18 for securing attachment 10 in the toilet bowl extends integrally and upwardly from an upper central portion of body section 12. Bracket 18 comprises a first, vertically oriented leg member 20 extending upwardly from the upper central portion of body section 12, a horizontally oriented base member 22 extending integrally and orthogonally, i.e. laterally outwardly, from leg 20, and a second, vertically oriented leg member 24 extending integrally and downwardly from base 22 in parallel relationship to leg 20. Bracket 18 is dimensioned to snugly receive rim 26 of toilet bowl 25 to secure attachment 10, together with the toilet seat (not shown) lying over it, in its operative position (FIG. 1). Attachment 10** may be molded in one piece and composed of polymeric material.

Figure 3:
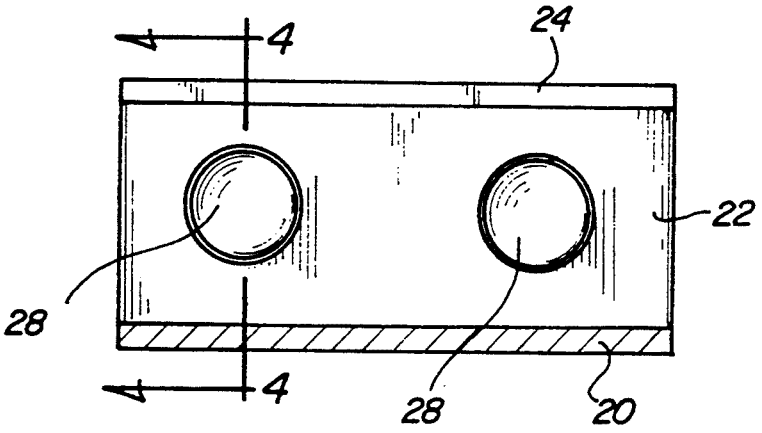
FIG. 3 is a cross-sectional view of the mounting bracket taken along line 3—3 in FIG. 2 which further includes a first addtitional securing means mounted thereon.
Figure 4:
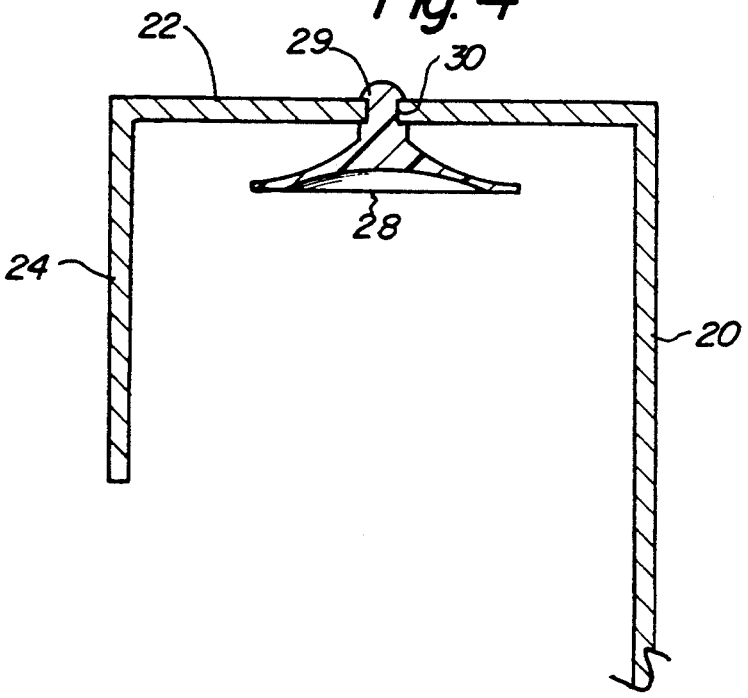
FIG. 4 is a cross-sectional view of the mounting bracket shown in FIG. 3 as taken along line 4—4 thereof.

Referring now to FIGS. 3 and 4, the retention of attachment 10 in toilet bowl 25 may be further augmented by means of a plurality of suction cups 28 which are mounted on base 22 in a position between legs 20 and 24 of bracket 18. Suction cups 28 include elongate, upwardly extending attaching stems 29. Base 22 is provided with a plurality of mounting holes 30. Cups 28 are mounted on base 22 by pressing stems 29 into holes 30 as shown in FIG. 4. Attachment 10 is then mounted in bowl 25 by pressing bracket 18 over bowl rim 26 so cups 28 are forced against the upper surface of rim 26 to cause further gripping retention of attachment 10 in bowl 25. Cups 28 may be composed of elastomeric material.

Figure 5:
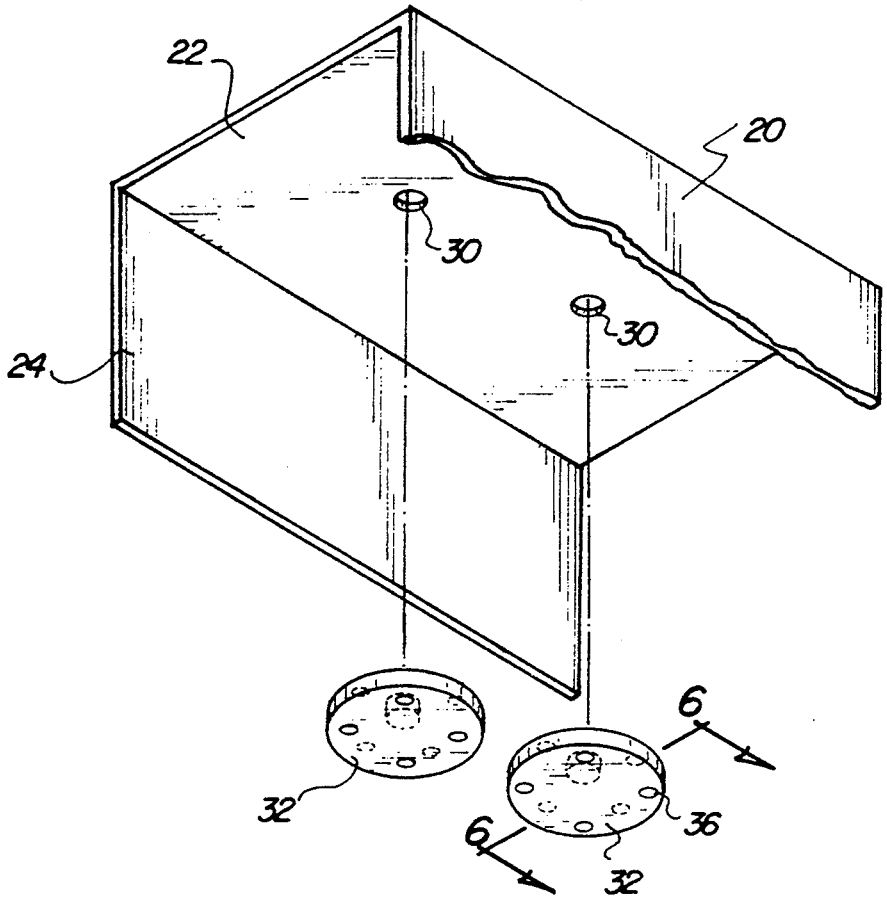
FIG. 5 is a partial perspective view, in exploded illustration, of the mounting bracket which further includes a second additional securing means mounted thereon.
Figure 6:
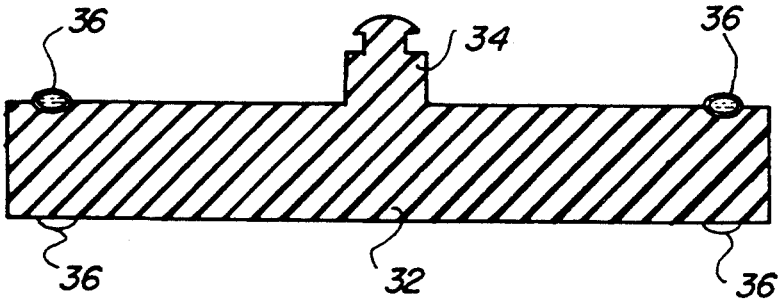
FIG. 6 is a cross-sectional view of one of the securing discs as take along line 6—6 in FIG. 5.

Alternatively, attachment 10 may be permanently secured to toilet bowl 25. As illustrated in FIGS. 5 and 6, the permanent mounting means comprises a plurality of securing discs 32 having elongate, upwardly extending attaching stems 34. Discs 32 may be composed of elastomeric material. Mounted in peripheral recesses on both planar surfaces of discs 34 are a plurality of glue-containing capsules 36. Discs 32 are first mounted within bracket 18 by pressing stems 34 into mounting holes 30 in base 22. The mounting pressure applied to discs 32 causes breakage of capsules 36 adjacent the upper planar surfaces of discs 32 and release of the glue therein to effect bonding of discs 32 to base 22. Attachment 10 is then placed on toilet rim 26 and pressed against its upper surface which causes breakage of capsules 36 adjacent the lower planar surfaces of discs 32 and release of the glue therein to permanently bond attachment 10 to toilet rim 26.

Figure 7:
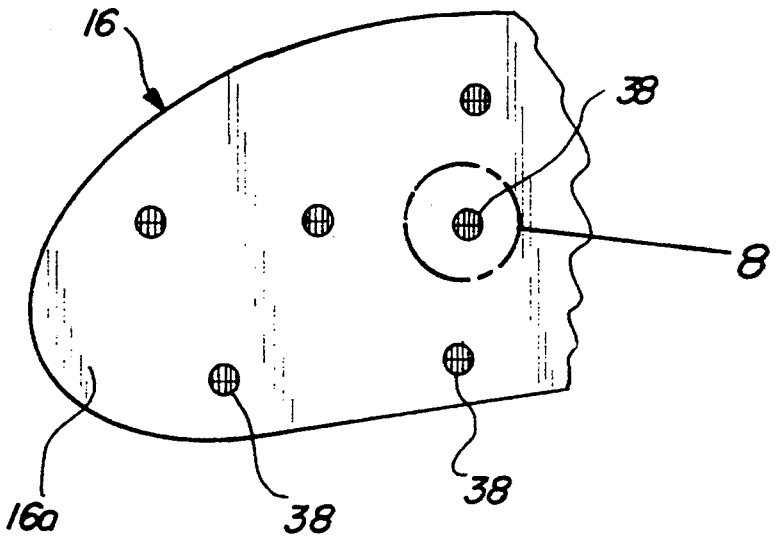
FIG. 7 is a partial front elevational view of a water deflecting fin as viewed in the direction of the arrows along line 7—7 in FIG. 1, which further includes the alternative disinfecting assemblies mounted thereon.
Figure 8:
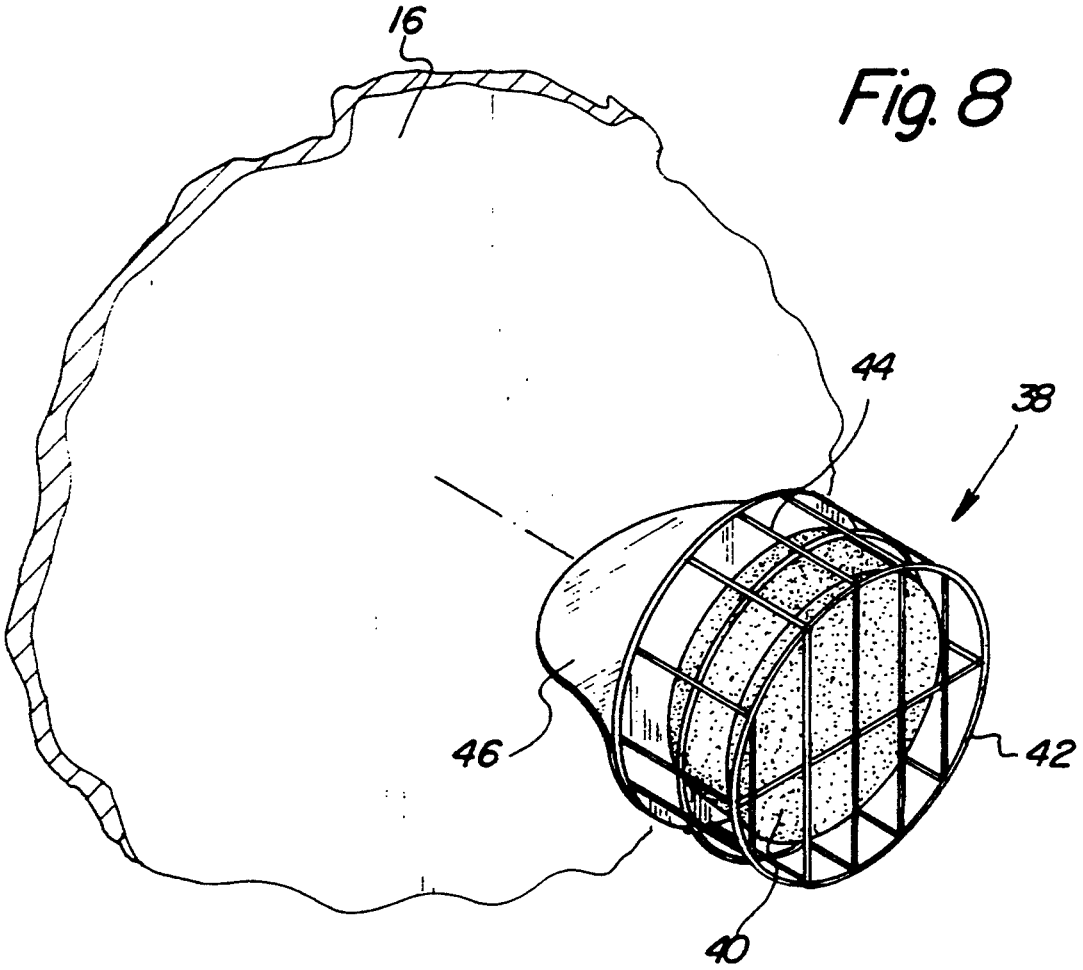
FIG. 8 is a perspective view, in exploded illustration, of those portions of the water deflecting fin lying within circle 8 in FIG. 7.

Further, toilet bowl 25 may be disinfected and deodorized during flushing using the structure depicted in FIGS. 7 and 8 which includes a plurality of assemblies 38 which are provided with solid disinfectant and deodorizing discs or tablets 40. Discs 40 are encased in cages 42 which have solid bases 42 at one end thereof. The outer planar surfaces of bases 42 are coated with a layer of an adhesive material (not shown). Covering the adhesively coated outer planar surfaces of bases 42 are removable backings 44. Assemblies 38 may be mounted on the inner planar surface 16*a* of fin 16 by simply peeling backings 44 from cage bases 42 and pressing them against surface 16*a* causing an adhesive bonding of assemblies 38 to fin surface 16*a*.

In use, attachment 10 is mounted on rim 26 of toilet bowl 25, either removably or permanently, as described above. When the toilet is flushed, water is introduced into bowl 25 in the conventional manner, i.e. from angular holes under rim 26 so that the water swirls along the inner wall of bowl 25 in the direction of arrow A as shown in FIG. 1. The flushing water is first intercepted by fin 14. Since fin 14 is in contact with the inner wall of bowl 25, it intercepts the water and "peels" or "scrapes" it from the bowl wall and redirects it over the outer planar surfaces of fin 14 and body section 12 and then against planar surface 16*a* of fin 16. This collision of the water with surface 16*a* causes an increase in velocity, turbulence, and swirling motion of the water, and thus more rapidly and completely directs the water and waste material toward the center and downwardly in bowl 25 thereby effecting a more rapid removal therefrom, as well as a more thorough cleaning of bowl 25. Further, during the contact of the bowl water with fin surface 16*a*, the water is also brought into contact with discs or tablets 40 of assemblies 38 to cause disinfecting and deodorizing of bowl 25.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet bowl flushing attachment comprising:
a main body section having a central portion defining generally a plane bounded by a pair of opposed sides; a first water deflecting fin having a first generally planar surface extending angularly from one side opposed sides of said main body in one direction; a second water deflecting fin having a second generally planar surface extending angularly from said opposed side of said main body and a mounting means extending upwardly from said central portion, said mounting means being dimensioned to snugly receive and grasp a rim of a toilet bowl in a manner wherein said main body and said first and second deflecting fins lie within said toilet bowl, with said first deflecting fin extending outwardly towards an inner wall of said toilet bowl so as to direct flushing water over said first planar surface, and onto said central portion, and said second deflecting fin extends inwardly so as to direct said water from said plane towards a central area of said toilet bowl.

2. The toilet bowl flushing attachment of claim 1,
wherein said main body, first and second water deflecting fins, and said mounting means are composed of polymeric material.

3. The toilet bowl flushing attachment of claim 2,
wherein said main body, said first and second water deflecting fins, and said mounting means are molded in one piece.

4. The toilet bowl flushing attachment of claim 1,
wherein said first water deflecting fin forms an acute angle with said plane.

5. The toilet bowl flushing attachment of claim 4,
wherein said second water deflecting fin forms an angle of approximately 90 degrees with said plane.

6. The toilet flushing attachment of claim 5,
further comprising means for disinfecting said toilet bowl including a plurality of disinfecting assemblies mounted on said second generally planar surface of said second water deflecting fin, wherein each of said disinfecting assemblies comprises a cage member, a disinfectant tablet positioned within said cage member, a base member mounted at one end of said cage member, and a layer of adhesive material on an outer surface of said base member for securing said disinfecting assemblies on said second generally planar surface of said second water deflecting fin.

7. The toilet bowl flushing attachment of claim 1, wherein said mounting means is channel-shaped and includes a vertically oriented first leg member extending upwardly from said central portion, a horizontally oriented base member extending orthogonally from said first leg member, and a vertically oriented second leg member extending downwardly from said base member in parallel relationship with said first leg member.

8. The toilet bowl flushing attachment of claim 7, further comprising retention means for additionally securing said attachment to said toilet bowl rim, said retention means including a plurality of mounting holes in said base member, and a suction cup mounted in each of said mounting holes in a manner wherein each of said suction cups is positioned between said first and second leg members of said channel-shaped bracket for contacting said toilet bowl rim and frictionally securing said attachment thereto.

9. The toilet bowl flushing attachment of claim 8, wherein said suction cups are composed of elastomeric material.

10. The toilet bowl flushing attachment of claim 7, further comprising retention means for additionally securing said attachment to said toilet bowl rim, said retention means including a plurality of mounting holes in said base member, and a securing disc mounted in each of said mounting holes, wherein each of said securing discs has a plurality of glue-containing capsules positioned adjacent upper and lower peripheral portions of said disc for permanently fixing said discs to said base member and said attachment to said toilet bowl rim.

11. The toilet bowl flushing attachment of claim 10, wherein said securing discs are composed of elastomeric material.

* * * * *